US005511658A

United States Patent [19]

Focke et al.

[11] Patent Number: 5,511,658

[45] Date of Patent: Apr. 30, 1996

[54] SOFT PACK FOR CIGARETTES

[75] Inventors: Heinz Focke; Harald Gosebruch, both of Verden, Germany

[73] Assignee: Focke & Co. (GmbH & Co.), Verden, Germany

[21] Appl. No.: 299,408

[22] Filed: Sep. 1, 1994

[30] Foreign Application Priority Data

Sep. 1, 1993 [DE] Germany ..... 43 29 368.9

[51] Int. Cl.[6] ..... B65D 85/10

[52] U.S. Cl. ..... 206/271; 206/264; 206/268; 206/273; 229/160.1

[58] Field of Search ..... 206/263, 264, 206/271, 273, 268; 229/160.1

[56] References Cited

U.S. PATENT DOCUMENTS

| | | | |
|---|---|---|---|
| 3,093,292 | 6/1963 | Ahlbor | 206/264 X |
| 3,944,066 | 3/1976 | Niepmann | 206/273 |
| 4,003,467 | 1/1977 | Focke et al. | 206/273 |
| 4,294,642 | 10/1981 | Focke et al. | 206/273 |
| 4,300,676 | 11/1981 | Folke et al. | 206/264 |
| 4,375,260 | 3/1983 | Focke et al. | 206/264 |
| 4,607,748 | 8/1986 | Focke | 206/254 |
| 4,715,497 | 12/1987 | Focke et al. | 206/254 |
| 4,776,461 | 10/1988 | Focke et al. | 206/271 |
| 4,789,060 | 12/1988 | Focke et al. | 206/274 |
| 5,080,227 | 1/1992 | Focke | 206/273 |
| 5,184,725 | 2/1993 | Reinheimer et al. | 206/494 |
| 5,301,804 | 4/1994 | Focke et al. | 206/271 |

FOREIGN PATENT DOCUMENTS

| | | |
|---|---|---|
| 2001290 | 2/1969 | France . |
| 906915 | 2/1954 | Germany . |
| 2639216 | 3/1978 | Germany . |
| 3529119 | 2/1987 | Germany . |
| 9109814 | 11/1991 | Germany . |
| 4202258 | 7/1993 | Germany . |
| 554774 | 10/1974 | Switzerland . |
| 607542 | 2/1974 | U.S.S.R. . |

*Primary Examiner*—Jimmy G. Foster
*Assistant Examiner*—Tara Laster
*Attorney, Agent, or Firm*—Sughrue, Mion, Zinn, Macpeak & Seas

[57] ABSTRACT

For better protecting the cigarettes of a soft pack, the outer wrapping thereof is configured from paper or film such that a removal opening (25), which can be re-closed a number of times by a closure flap (27), is formed. The closure flap (27) covers over the removal opening (25) and is releasably fixed on a front wall (14) of the pack. The cigarettes (10) or the cigarette group (11) is enclosed by an inner blank (12) consisting of paper or tin foil. This is provided on the front side with a pull-off flap (57) in order to ensure access to the cigarettes when the pack is used.

2 Claims, 7 Drawing Sheets

SOFT PACK FOR CIGARETTES

BACKGROUND OF THE INVENTION

The invention relates to a cuboidal soft pack for cigarettes.

Amongst the types of cigarette packs seen the world over, the soft pack stands out as a result of the comparatively low material consumption. In the case of a conventional soft pack, a group of cigarettes (cigarette group) is enclosed by an inner wrapping, usually consisting of tin foil. The resulting cigarette block is placed in an upwardly open paper wrapping, namely in the soft carton. A cellophane blank or poly-blank may be used as the outer wrapping.

The disadvantage of this soft-cup pack, which is widespread throughout the world, is its handling. When first using the soft-cup pack a sub-region of a folded, top end wall of the inner wrapping (tin-foil blank) is removed by separating it off, with the result that a removal opening is formed in the region of the end wall. However, it is only with great difficulty that the cigarettes can be gripped, in the region of said removal opening, in order to remove them from the pack. Furthermore, it is disadvantageous that the cigarettes, with the corresponding relative position of the pack, can slip out of the removal opening. Dirt can also penetrate into the open pack.

SUMMARY OF THE INVENTION

Taking this as a departure point, the object of the invention is to provide a novel type of soft pack for cigarettes which maintains the advantages of the favorable use of material for this type of pack, but eliminates the above-described disadvantages resulting from a removal opening which is to be formed by separating off regions of a blank.

In order to achieve this object, the cigarette pack according to the invention is defined by the following features:

a) a group of cigarettes, that is to say a cigarette group, is enclosed on all sides by an inner blank, consisting of paper, tin foil or film, in order to form a cigarette block, b) an outer wrapping having a front wall, rear wall, end wall, base wall and side walls consists of a thin packaging material, in particular paper or film, c) the outer wrapping is provided with a removal opening, extending in the region of front wall and bordering end wall, for the cigarettes, d) the removal opening can be closed by a closure flap which is formed by the outer wrapping and covers the removal opening with an overlap.

The core of the soft pack for cigarettes, according to the invention, is thus a predetermined removal opening which is formed as a result of the configuration of the paper or film wrapping and can be re-closed. Consequently, the procedure of removing cigarettes and closing the removal opening can be repeated in keeping with the use of the pack.

A pack in accordance with the invention is particularly advantageous if the inner wrapping or the inner blank exhibits, in the region of the removal opening, a removable flap which is formed as part of the inner blank by perforations or in some other manner. Up until now, such a flap has not been conventional or possible in the case of soft packs for cigarettes. The removal opening extending in the region of front wall and end wall ensures particularly favorable access to the cigarettes.

The blank for the outer wrapping, in particular consisting of paper, is configured such that the risk of tearing is reduced upon opening and re-closing the pack a number of times. This is ensured by connecting flaps and/or corner flaps which extend between the closure flap and side walls of the outer wrapping.

Further features of the invention relate to the configuration of the blank for the outer wrapping and to measures for ensuring the closability of the soft pack.

Exemplary embodiments of the pack according to the invention are illustrated in more detail hereinbelow with reference to the drawings, in which:

DESCRIPTION OF PREFERRED EMBODIMENTS

Figure 5:
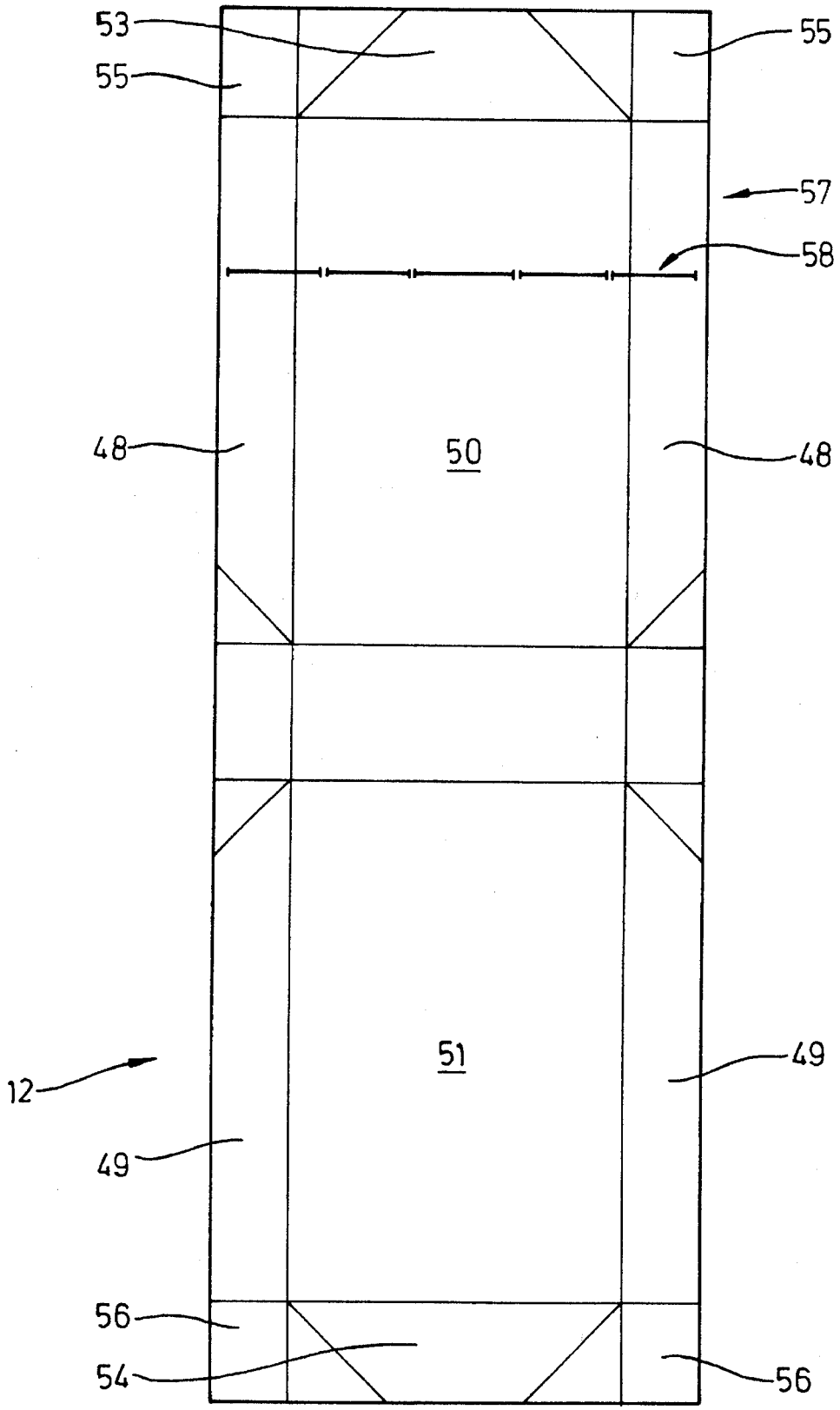
FIG. 5 shows an inner blank in the spread-out state.

The exemplary embodiments represented of cuboidal soft packs for cigarettes 10 are composed of an inner blank 12, enclosing a cigarette group 11, in the configuration according to FIG. 5 of an outer wrapping consisting preferably of paper, and optionally of an outer film envelope (not shown). The cigarette group 11 sheathed by the inner blank 12 forms a cigarette block 13 which is enclosed by the outer wrapping.

The most important part of the pack is the outer wrapping consisting of paper or, alternatively, of plastic film. This is designed such that front wall 14, rear wall 15, narrow, elongate side walls 16, 17, a folded base wall 18 and an end wall 19 are formed. A blank 20 or 21 for said outer wrapping (FIG. 4) is, in the present case, wrapped around the cigarette block 13 in the transverse direction such that, in the region of a side wall, a strip 22 formed on the opposite border of the blank is connected to the side wall 17 by adhesive bonding or by thermal sealing. Folding tabs are folded in a conventional manner in order to form the base wall 18, namely as "envelope" folding with trapezoidal folding tabs 23, 24 which partially overlap one another.

The blank for the outer wrapping is configured such that a removal opening 25 is formed in the region of front wall 14 and bordering end wall 19. Said removal opening 25 is delimited, in that region of the front wall 14 adjacent to the end wall 19, by an arcuate opening edge 26. The removal opening 25 extends here virtually over the entire width of the front wall 14. When the pack is open (FIG. 2 and FIG. 7), the end wall 19 is completely unobstructed, with the result that each cigarette—when the inner blank is likewise open—can be gripped.

The removal opening 25 can be closed by a closure flap 27. In the closed position (FIG. 1 and FIG. 6), said closure flap 27 rests against the front wall 14. In this region, the removal opening 25 is closed by the closure flap 27 with a considerable overlap.

In order to fix the closure flap in the closed position even after the soft pack has been opened a number of times, an end region of the closure flap 27, namely a tongue 28, extending, in the closed position, in the region of the front wall 14 is releasably fixed on the front wall 14, in the present case by means of a spot of glue 29. Alternatively, an adhesive strip with an adhesive-free grip end may also be used.

The head-side region, directed towards the end wall 19, of the soft pack is of a special configuration. The closure flap 27 is connected to the rear wall 15, forms, with a sub-region, the end wall 19 itself and extends, with the tongue 28, in the region of the front wall 14, in doing so covering over the removal opening 25. The spot of glue 29 is provided beneath the removal opening 25.

Folding gussets 30, 31 are connected to the closure flap 27 on both sides. Said gussets connect the side walls 16 and 17, on the one hand, to the closure flap 27, on the other hand. In the closed position, the folding gussets 30, 31 are folded inwards via an approximately central folding line 32, 33 such that each folding gusset 30, 31 forms two folding triangles 34, 35 located one upon the other. Said folding triangles are located one upon the other, to be precise between that part of the closure flap 27 which forms the end wall 19 and the cigarette block 13. The folding lines 32, 33 are preformed in a suitable manner, said folding lines 32, 33 being formed by thermal stamping in the case of an outer wrapping consisting of film. Consequently, the folding gussets 30, 31 are automatically folded into the described position when the pack is closed.

The folding gussets 30, 31 are configured such that their obliquely running outer edge 36, 37 forms a rectilinear or bend-free continuation of the contour of the closure flap 27, namely the tongue 28 of the same. In the case of the exemplary embodiments shown, the border edge 38 of said tongue continues in a rectilinear manner in the region of the outer edges 36, 37.

Figure 4:
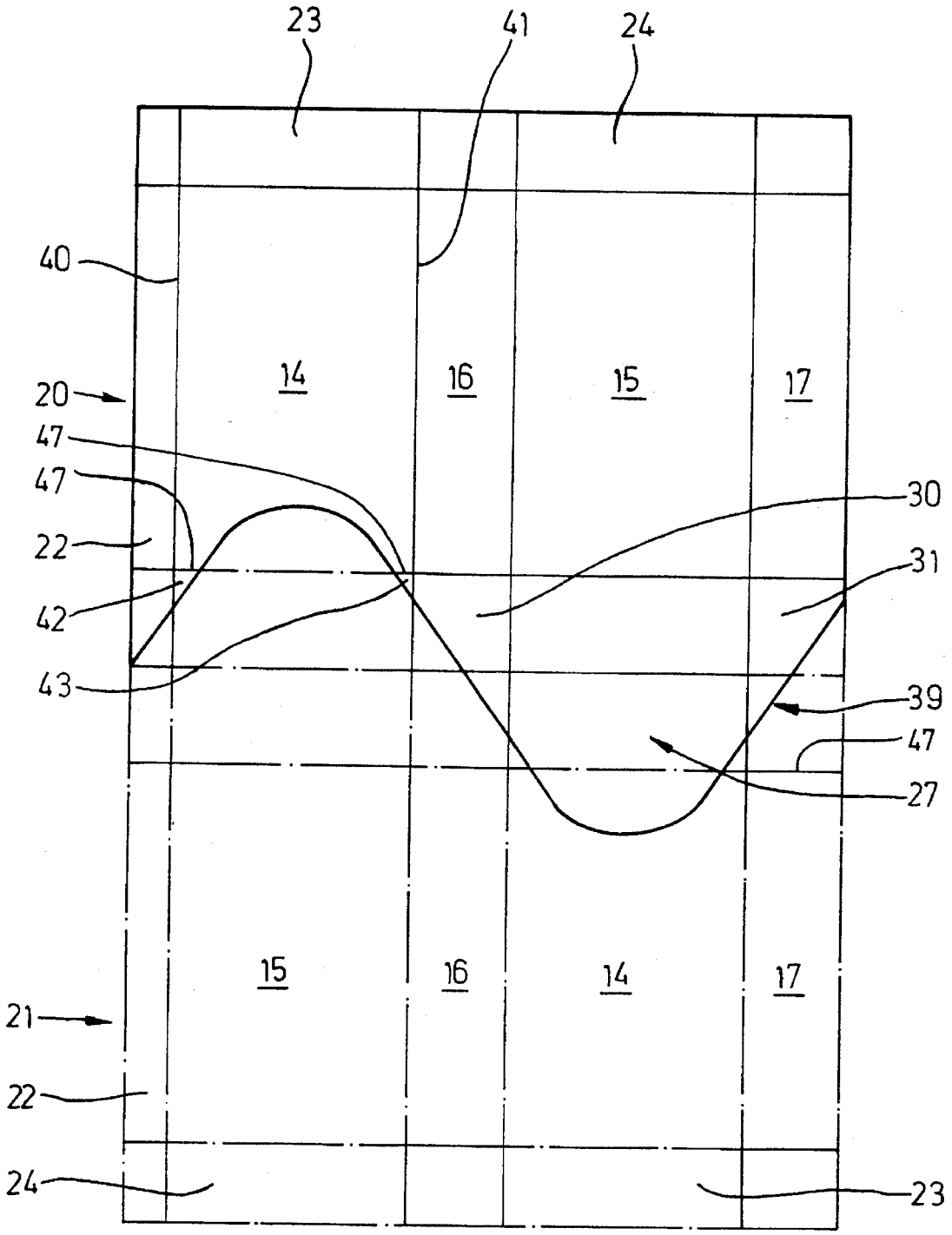
FIG. 4 shows a portion of a material web having blanks for the outer wrapping (paper)
Figure 8:
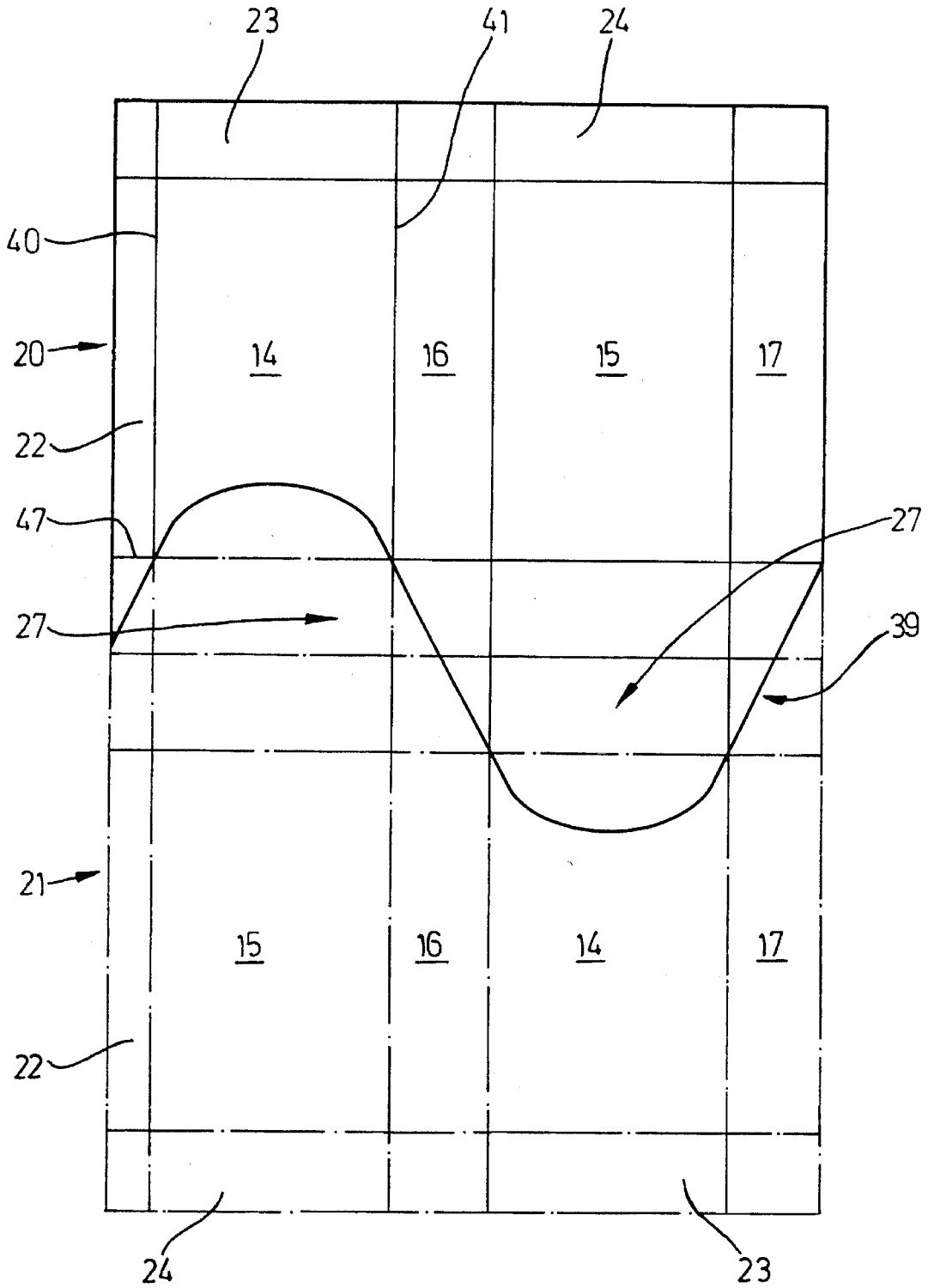
FIG. 8 shows a portion of a material web (paper) for blanks of the outer wrapping of packs according to FIGS. 6 and 7.

This results in a corresponding contour of blanks 20, 21, which are manufactured, according to FIGS. 4 and 8, from a double-width, continuous material web, in particular consisting of paper. In each case two blanks 20, 21 are located one beside the other in this arrangement and are separated from one another by an undulate separating cut 39. The latter results in the described form of the closure flap 27 and of the folding gussets 30, 31 on one side and of the removal opening 25 on the other side.

Figure 1:
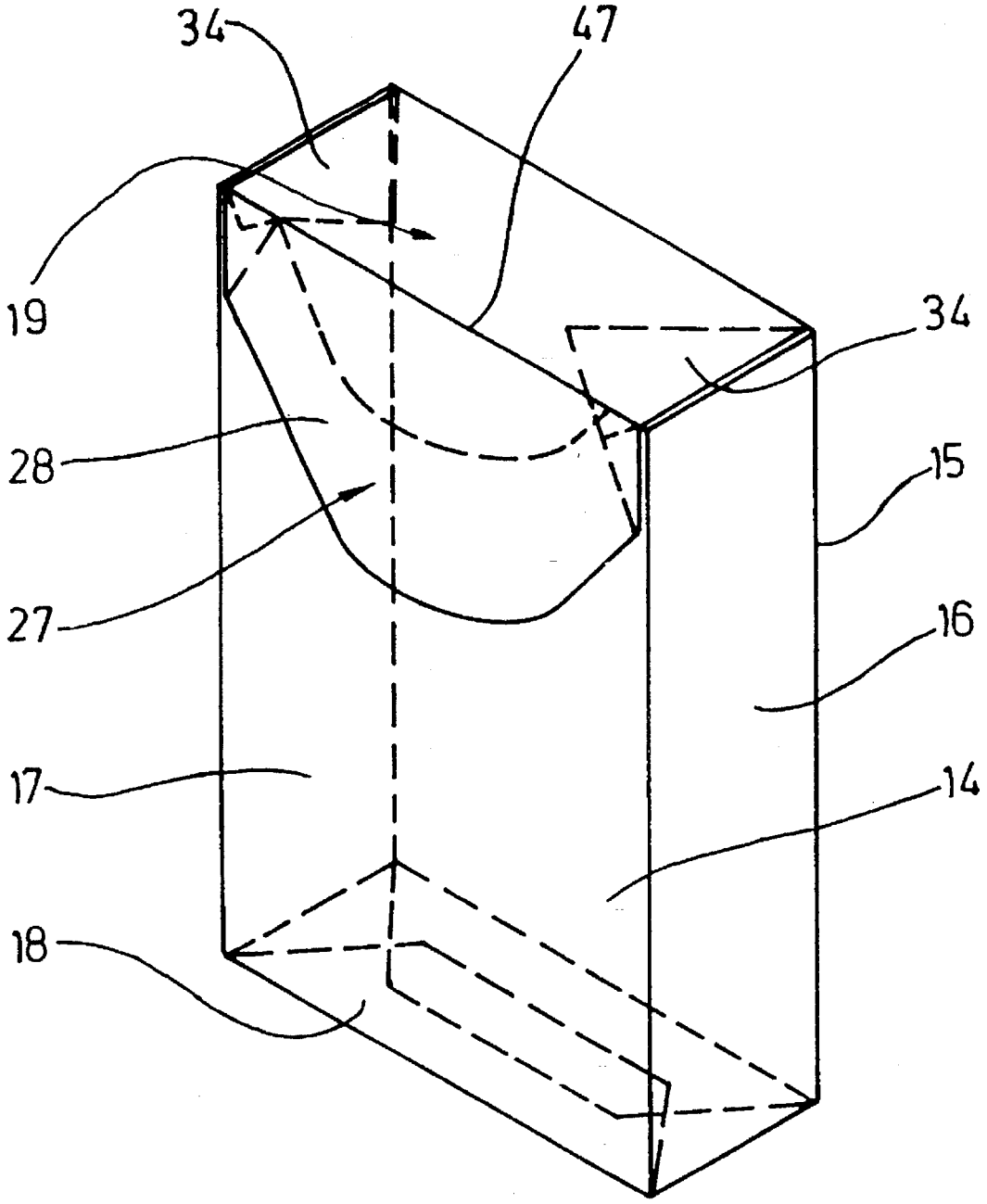
FIG. 1 shows, in a perspective representation, a soft pack for cigarettes in the closed position.
Figure 2:
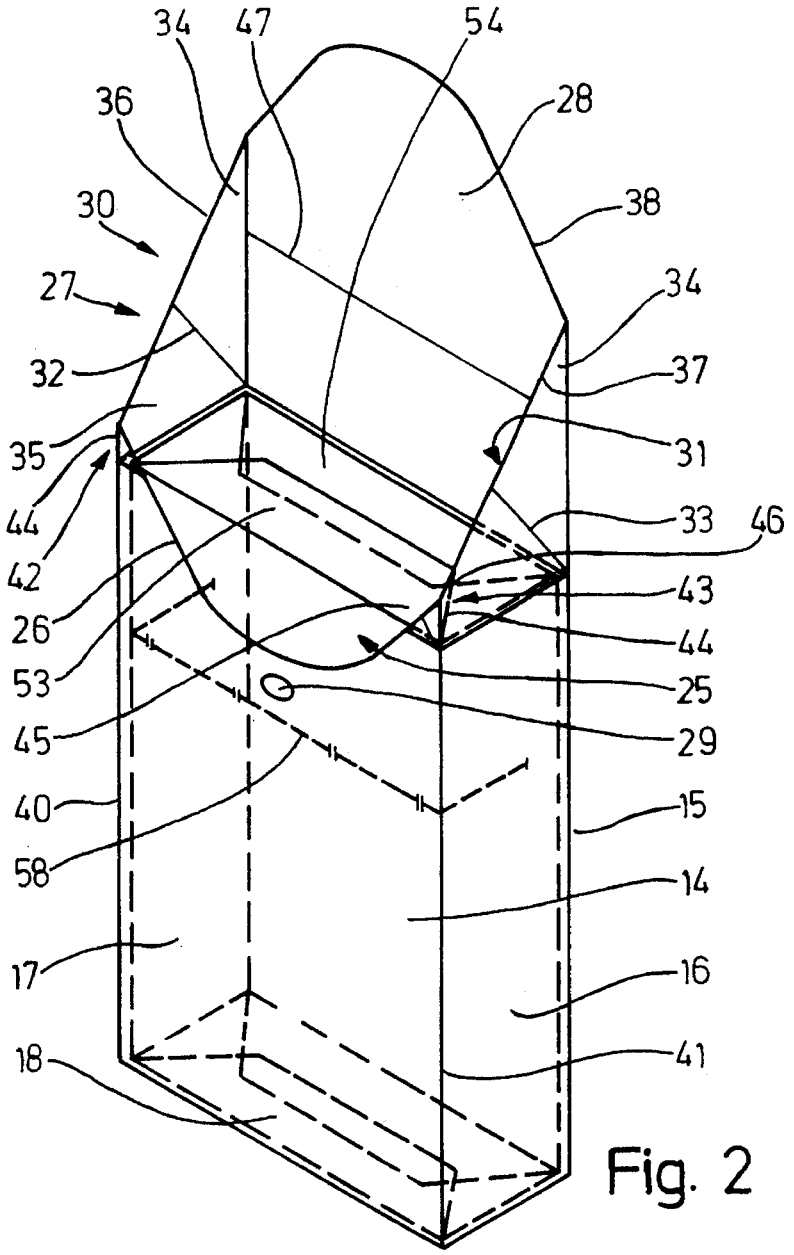
FIG. 2 shows the pack according to FIG. 1 in the open position, likewise in perspective.
Figure 3:
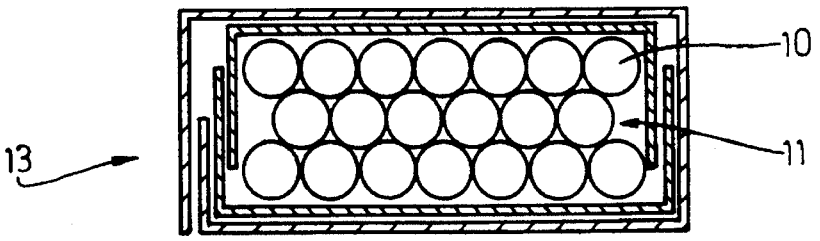
FIG. 3 shows a horizontal section through the pack according to FIGS. 1 and 2.

The pack configured according to FIGS. 1 and 2 has a special feature. In the region of the front wall 14, the removal opening 25, by virtue of corresponding positioning of the separating cut 39 in the material web, is of a smaller width than said front wall. This results, when the pack is open (FIG. 2), in upright corner pieces 42, 43, extending over the corners, on both sides of the front wall 14, in extension of upright front edges 40, 41. Said corner pieces increase the dimensional stability of the pack in the open position and protect the open region from the risk of tearing. When the pack is closed, the corner pieces 42, 43 are likewise folded inwards, that is to say beneath the closure flap 27. For this purpose, in each case a corner folding line 44 in continuation of the front edges 40, 41, an oblique folding line 45 and a transverse folding line 46 are provided in the region of the corner piece 42, 43. With the aid of these folding lines, the corner pieces 42, 43 are folded inwards into the position shown in FIG. 1.

Figure 6:
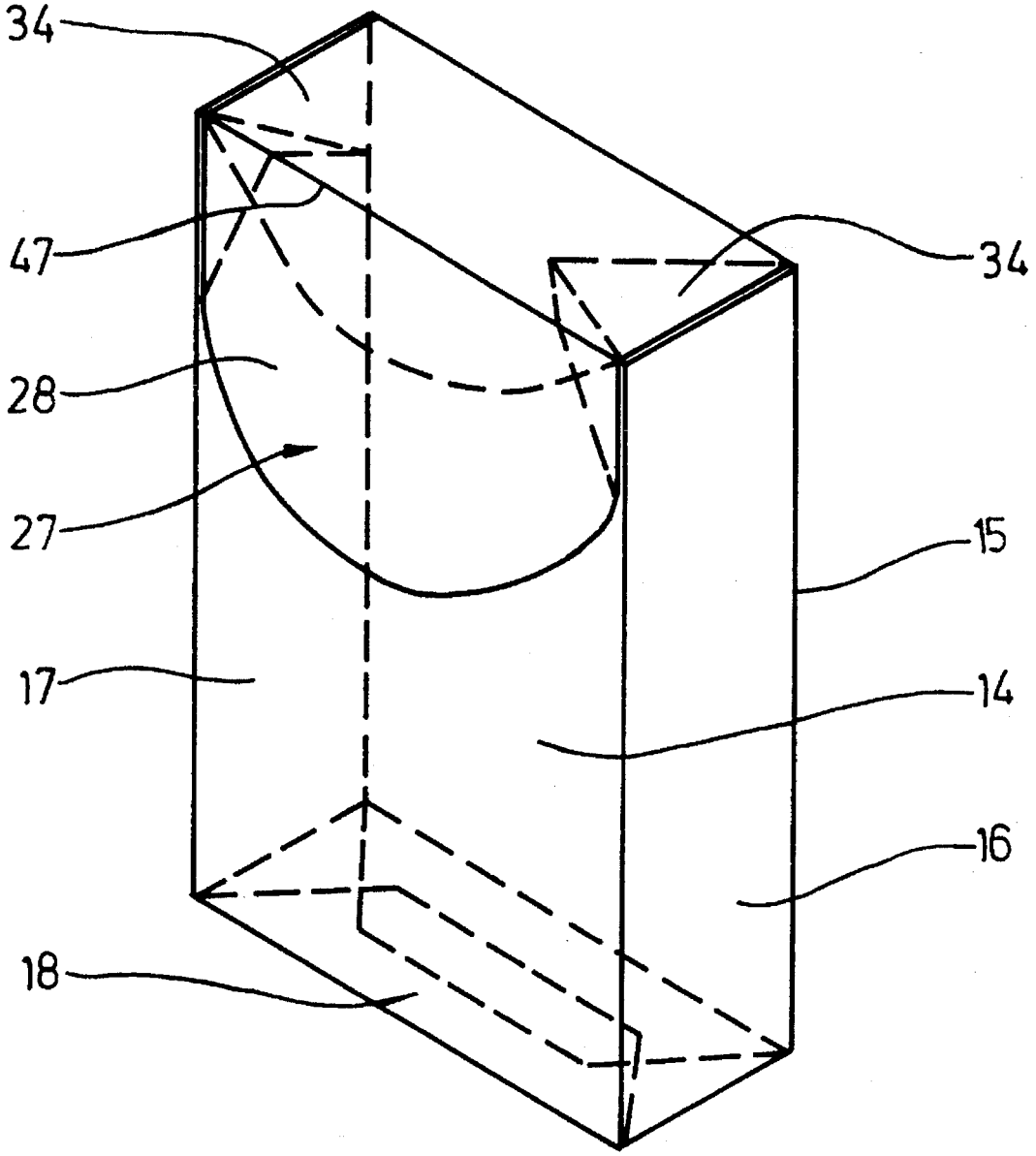
FIG. 6 shows, in a perspective representation, a different embodiment of a soft pack for cigarettes in the closed position.
Figure 7:
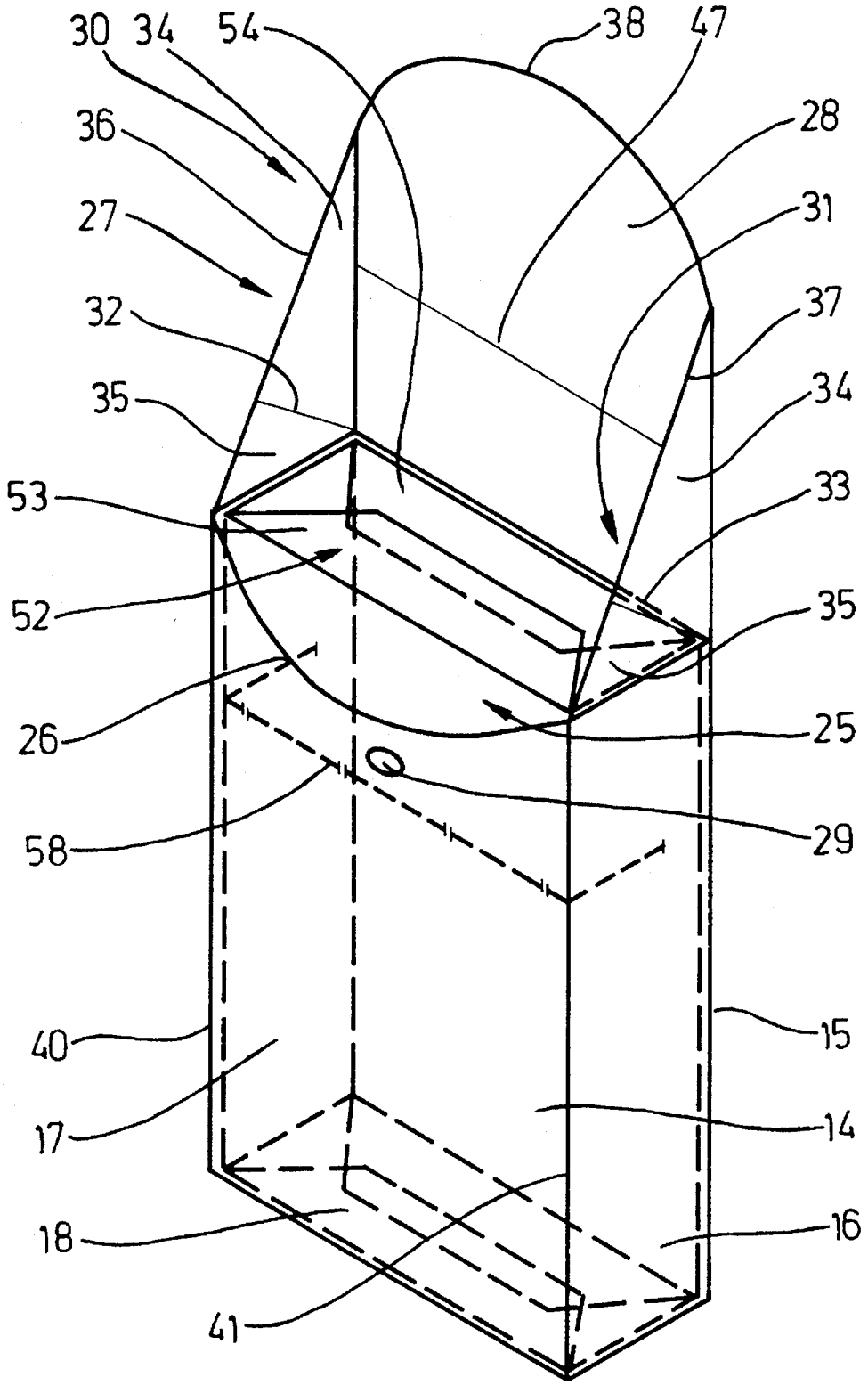
FIG. 7 shows the soft pack according to Figure 6 in the open position.

In the embodiment according to FIGS. 6 to 8 of the pack, the removal opening 25 is configured such that, in the region of the front wall, namely in the region of a top transverse edge 47 of the pack, said removal opening extends over the entire width of the pack. For forming the blanks 20, 21, the separating cut 39 thus runs through corner points marked by the folding lines, as shown in FIG. 8. In order to form a pack according to FIGS. 1 and 2, the separating cut 39 is arranged, corresponding to the representation according to Figure 4, such that it is offset with respect to the points of intersection of the folding lines.

In the case of both embodiments of the pack, the folding gussets 30, 31 are designed to have such a length (of the outer edge 36, 37) that, in the closed position, in each case a sub-region of the folding gussets 30, 31 is located, with the tongue 28, in the region of the front wall 14, to be precise between tongue 28 and front wall 14.

In a specific manner, the inner blank 12 is also configured from paper or tin foil. Said blank sheathes the cigarette group 11 such that mutually overlapping side strips 48, 49 are formed in the region of the side walls 16, 17 of the pack. An inner front wall 50 is assigned to the front wall 14 and an inner rear wall 51 is assigned to the rear wall 15. An inner end wall 52 comprises folding tabs which partially overlap one another, namely an outer, trapezoidal longitudinal tab 53 and an inner longitudinal tab 54 which is directed towards the rear wall 15. Furthermore, the inner end wall 52 is formed by front corner tabs 55 and rear corner tabs 56.

The special feature consists in the formation of a pull-off flap 57 as part of the inner blank 12. In the case of the present exemplary embodiment, said flap is separated off from the rest of the inner blank 12 by a transversely directed perforation line 58. The perforation line 58 extends in the region of the inner front wall 50 and of the bordering side strips 48.

When the pack is in the finished state, the perforation line 58 extends in the region of the front wall 14, at a clear distance beneath the removal opening 25. The perforation line 58 is thus completely covered by the front wall.

When the pack is used, first of all the outer wrapping is opened with the aid of the closure flap 27, the latter being moved into the position according to FIG. 2 or according to FIG. 7. The exposed, top longitudinal tab 53 of the inner blank 12 can then be gripped and raised. Upon exerting further tension, the flap 57 is released from the rest of the inner blank 12. The inner blank 12 is removed in the region of the inner front wall 50 and bordering side strips 48. The cigarettes are then exposed in the front, top region, that is to say in a favorable position within the removal opening 25.

After a cigarette has been removed, the pack, namely the outer wrapping, can be closed again by means of the closure flap 27.

The pack may additionally be provided with a cellophane or film wrapping in order to protect against loss of flavor and moisture from the cigarettes before the pack is used.

What is claimed is:

1. A soft pack for cigarettes, comprising:

a) an inner wrapping enclosing a group of cigarettes on all sides to form a cigarette block (13), said inner wrapping (12) consisting of paper, tin foil or film; and b) an outer wrapping having a front wall (14), a rear wall (15), two side walls (16, 17), a base wall (18) and an end wall (19) and consisting only of a thin packaging material in the form of thin paper or a plastic film; wherein c) the outer wrapping has a removal opening (25) which extends in the front wall (14) and the bordering end wall (19), and which permits removal of the cigarettes (10), and .

d) the outer wrapping forms a closure flap (27) which closes the removal opening, and which covers the removal opening (25) with an overlap in a closed position of the pack;

wherein the inner wrapping (12) is provided, in the region of the removal opening (25), with a pull-off flap (57) which is delimited by perforations or punchings and whose bottom delimitation, namely a transversely directed perforation line (58), is arranged at least in the region of the front wall (14), at a distance beneath the removal opening (25).

2. A soft pack for cigarettes, comprising:

a) an inner wrapping enclosing a group of cigarettes on all sides to form a cigarette block (13), said inner wrapping (12) consisting of paper, tin foil or film; and b) an outer wrapping having a front wall (14), a rear wall (15), two side walls (16, 17), a base wall (18) and an end wall (19), and consisting only of a thin packaging material in the form of thin paper or a plastic film; wherein c) the outer wrapping has a removal opening (25) which extends in the front wall (14) and the bordering end wall (19), and which permits removal of the cigarettes (10), and d) the outer wrapping forms a closure flap (27) which closes the removal opening, and which covers the removal opening (25) with an overlap in a closed position of the pack;

wherein, in the region of the front wall (14), the removal opening (25) is of a smaller width than said front wall, such that there are formed in the region of the front wall of the soft pack, and in extension of upright front corner edges (40, 41 ) of the pack, two corner pieces (42, 43) which, when the soft pack is in said closed position, are likewise folded inwards into said folded position beneath the closure flap (27).

* * * * *